US005733167A

United States Patent [19]

Krøigaard

[11] Patent Number: 5,733,167

[45] Date of Patent: Mar. 31, 1998

[54] BUILDING ELEMENT HAVING AN INCORPORATED SOURCE OF LIGHT

[75] Inventor: Olav Krøigaard, Vejle, Denmark

[73] Assignee: INTERLEGO AG, Baar, Switzerland

[21] Appl. No.: 713,693

[22] Filed: Sep. 13, 1996

[30] Foreign Application Priority Data

Sep. 14, 1995 [DK] Denmark ..... 1022/95

[51] Int. Cl.[6] ..... A63H 33/04; A63H 33/26; A13H 33/08

[52] U.S. Cl. ..... 446/91; 446/219; 446/485; 446/128; 132/32; 132/35

[58] Field of Search ..... 446/91, 128, 219, 446/484, 485; 132/32, 35, 287

[56] References Cited

U.S. PATENT DOCUMENTS

| | | | |
|---|---|---|---|
| 1,174,240 | 3/1916 | Dussaud | 362/35 X |
| 2,443,631 | 6/1948 | McDermott et al. | 362/35 X |
| 3,654,710 | 4/1972 | Barnard | 446/485 X |
| 3,831,017 | 8/1974 | Auer | 362/32 |
| 5,029,047 | 7/1991 | Kachel | 362/32 |
| 5,041,947 | 8/1991 | Yuen et al. | 362/35 |
| 5,365,413 | 11/1994 | Krammer | 362/35 X |
| 5,387,146 | 2/1995 | Smith et al. | 446/219 X |
| 5,585,782 | 12/1996 | Yosko | 362/35 X |

FOREIGN PATENT DOCUMENTS

| | | | |
|---|---|---|---|
| WO87/04365 | 7/1987 | WIPO | 446/91 |

*Primary Examiner*—D. Neal Muir

*Attorney, Agent, or Firm*—Kane,Dalsimer,Sullivan, Kurucz, Levy, Eisele and Richard, LLP

[57] ABSTRACT

A building element (10) for a constructional building set comprises a housing (11, 12) and a light source (15) mounted in it. The light source (15) is mounted on a rotatably mounted member (14) spaced from the axis of rotation (13) of the member. The housing (11, 12) includes a wall having a plurality of light exit openings (16) through which the light from the light source (15) can leave the housing (11, 12), when the light emitter (15) has been aligned with one of the light exit openings (16) by rotation of the rotatable member (14). The rotatable member (14) can be coupled with an external drive device (20) and is enclosed by the housing (11, 12). The rotatable member is freely rotatable about its axis of rotation (13) with respect to the housing (11, 12).

10 Claims, 2 Drawing Sheets

BUILDING ELEMENT HAVING AN INCORPORATED SOURCE OF LIGHT

BACKGROUND OF THE INVENTION

The invention concerns a building element of the type defined in the introductory portion of claim 1.

In the field of constructional building sets there is a need for a light source which is capable of supplying light pulses to one or more fibres or the like with a view to transporting the energy to one or more discrete locations where the energy is emitted, or with a view to allowing fibres to serve as leaking optical fibres, so that the fibre may represent a circuit, e.g. the fuel supply to an engine.

GB 2 014 343 A discloses an illumination unit for optical fibres, where a light source is mounted on a rotatable disc. When the rotatable disc is rotated by a motor, the light source will periodically be aligned with successive openings where the fibre ends are mounted. Light pulses will hereby sequentially be emitted into the fibres. GB 2 014 343 A forms the basis for the art defined in the introductory portion of claim 1.

SUMMARY OF THE INVENTION

The object of the invention is to provide a building element of the type mentioned in the opening paragraph, which is to be capable of being implemented in a constructional building set, and which is to be capable of supplying light pulses having a frequency corresponding to the motion of a construction built with the constractional building set, without complex electronic control being needed and with a low power consumption.

This object is achieved An that a building element having the features defined in the introductory portion of claim 1 moreover has the constructive inventive features defined in the characterizing portion of claim 1.

The building element of the invention may advantageously have two opposed walls, and aligned holes formed in these may then serve as bearing rings for a through shaft part which carries the rotatable member. It will hereby be possible to make a bearing construction which is strong enough to form part of a constructional building set, and which is light at the same time. For reasons of space, the rotatable member may advantageously be made as a rotatable disc which is integral with the shaft part.

The light emitter may advantageously be a source of light in the form of a light emitting diode which is mounted on the component side of a disc-shaped ring of an insulating material. Metal paths are provided on the other side of the ring for cooperation with resilient collector shoes connected to an electrical input terminal in the housing. It will hereby be possible to establish electrical connection between the light source and a suitable electric power supply in a simple manner.

The ring is retained by means of geometrical locking on the shaft part in parallel with and with respect to the rotatable disc, so that the light emitting diode emits light toward said at least one light exit opening through a recess in the rotatable disc. The electrical components, which ere used for providing the correct voltage supply for the diode, between the component ring and the rotatable disc will hereby be protected.

The light exit openings may advantageously be provided along a circular arc corresponding to the distance travelled by the light emitter or light source upon rotation of the rotatable member.

The same light source can hereby supply light in the form of light pulses to several light exit openings.

When the coupling means of the rotatable member comprise a cruciform through bore in the shaft part in which a corresponding, cruciform drive shaft may be received releasably as a frictional fit, the building element can be used together with existing building elements marketed under the name of LEGO TECHNIC.

As stated in claim 8, the metal paths on the disc-shaped ring may be formed as a plurality of circular segments corresponding to the plurality of light exit openings, so that the contact to the voltage supply is closed only part of the time—when the light source is aligned with the light exit opening. This saves battery, since, usually, a battery constitutes the voltage source of the constructional building set.

When optical fibre elements are used for transporting the optical energy in the constructional building set, then, owing to optimum coupling of energy from light source to fibre, it will be expedient that bushings are provided in the associated housing wall in connection with the light exit openings, and that the bushings are formed with an internal shoulder, as the fibre end may hereby be positioned correctly each time.

Finally, the invention concerns a constructional building set comprising a building element with an incorporated light source and a plurality of fibre elements to distribute light in the building set. The building element has a housing in which the light source is incorporated. The light source is mounted on a rotatably mounted member spaced from the axis of rotation thereof, said housing including a wall having at least one light exit opening through which light from the light emitter may leave the housing when the light emitter has been aligned with said at least one light exit opening by rotation of the rotatable member. The rotatable member has means for coupling with an external drive device. The rotatably mounted member is surrounded by the housing and is freely rotatable about its axis of rotation with respect to the housing. The light exit openings have a bushing part having a cross-section which allows the fibre elements to be received and retained releasably by frictional coupling with the bushing parts. This combination of parts can illustrate a flow circuit in a construction built with the building set, if the fibres leak light through their sides. The combination may also be used for supplying scattered light emitters, of the fibres are terminated with e.g. an omnidirectionally emitting lens face.

BRIEF DESCRIPTION OF THE DRAWINGS

The invention will be described more fully below in connection with preferred embodiments and with reference to the drawing, in which.

DETAILED DESCRIPTION OF THE PREFERRED EMBODIMENT

Figure 1:
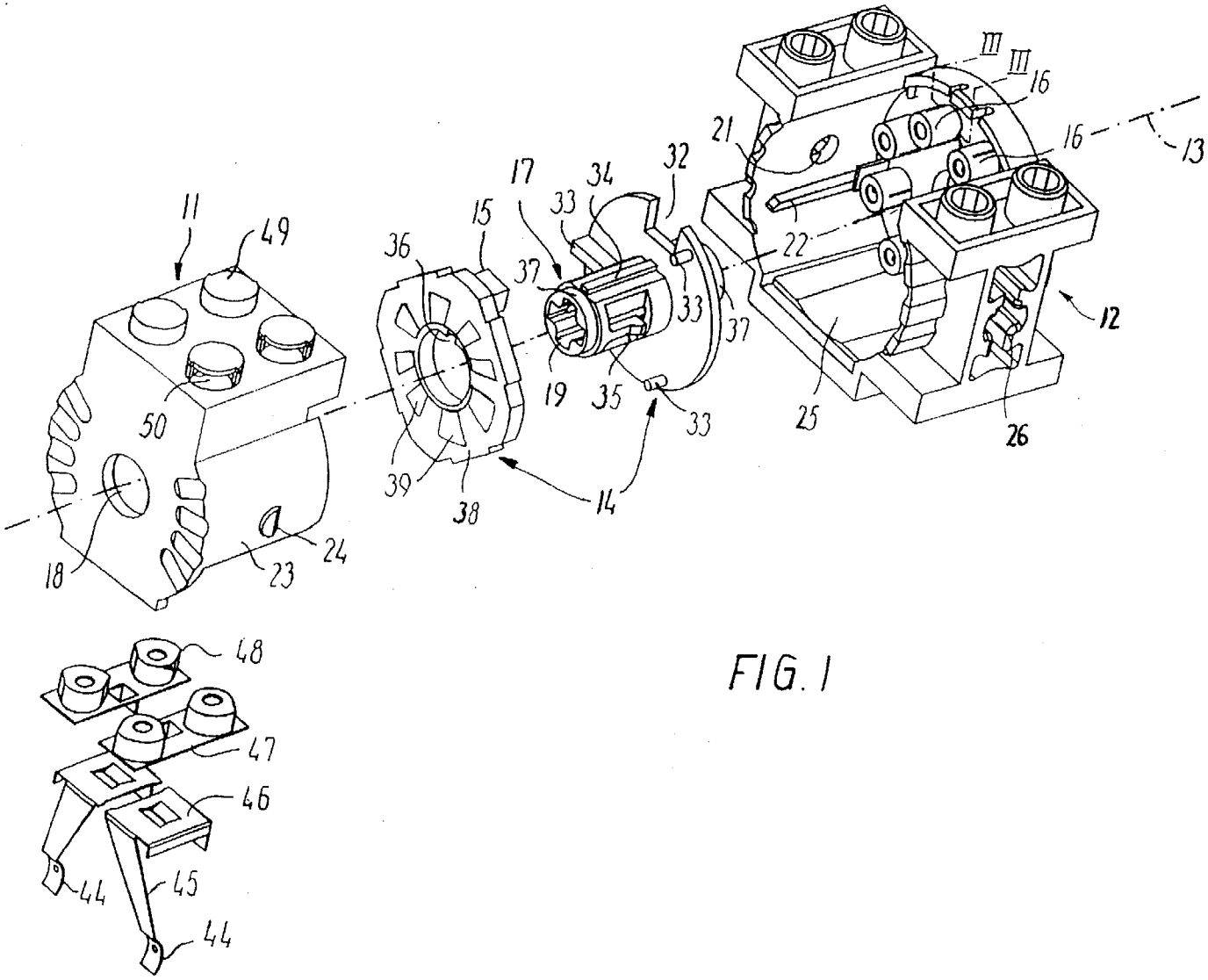
FIG. 1 is a schematic exploded view of a preferred embodiment of a building element having an incorporated light source according to the invention.

A building element for a constructional building set is shown in a preferred embodiment in exploded view in FIG. 1.

The building element comprises a housing 10 which consists of two parts 11 and 12 made by plastics injection moulding. When assembled, the housing 10 encloses a rotatably mounted member 14 on which a light source 15 is mounted spaced from the axis of rotation 13 of the member.

The housing 10 has a plurality of light exit openings 16—eight in the preferred embodiment—where the light from the light source 15 can leave the housing 10, when the light source 15 is aligned with one of the light exit openings by rotation of the rotatable member 14.

The rotatable member 14 has means for coupling with an external drive device, and in the preferred embodiment these means are provided in connection with a shaft part 14 on the member 14, said shaft part 17 being mounted at its ends 19 in two bearing holes 18 on respective housing parts 11 and 12, said shaft part ends 19 being hereby accessible from the outside. In the preferred embodiment, the shaft part 17 is constructed as a bushing having a through bore of non-circular cross-section for cooperation with a corresponding drive shaft 20, which may be received in the through bore of the shaft part 17. It will be seen that the through bore is cruciform so that the applicant's already marketed cruciform shafts may be used as drive shafts.

The rotatably mounted member is enclosed by the housing and is freely rotatable about its axis of rotation with respect to the housing. It can hereby follow the rotation of an external drive shaft and variations in the speed of rotation without complicated electronic control being needed. In the preferred embodiment, the building element 10 is constructed in accordance with the modular measures of the constructional building set marketed under the trade mark LEGO® and has a basic shape corresponding to a 4×2 basic brick having a double modular measure in the height. To create space in the housing for the rotatable member, the basic shape is increased by an extension of a one-third modular height at both the top and the bottom in the area at the four central coupling studs.

The part 12 has a cavity 25 in which the other part 11 may be received. The part 12 has two holes 21—one in each side—in which locking bosses 24, having an inclined guide face, of the part 11 may be received to provide an irreversible snap lock, which means that the parts cannot be separated after assembly without one of the parts being damaged. If it is desired that the parts 11 and 12 should be separable after assembly, the holes 21 may be formed as through holes, which makes it possible to press the locking bosses inwards via a recess 26 by means of a suitable tool, said locking bosses 24 being arranged on respective resilient sides 23 on the part 11.

The part 12 has two internal guide rails 22 on which the bottom edge of the sides 23 of the first part 11 slide during mounting. It will moreover be seen from FIG. 1 that the bottom edge is bevelled at the side facing away from the bearing hole 18, whereby the part is guided into position during mounting. The rail/bottom engagement moreover ensures that the parts cannot be rotated with respect to each other after mounting.

The building element 10 has two recesses 26—one in each side—enabling it to be coupled with shafts of cruciform cross-section.

Figure 3:
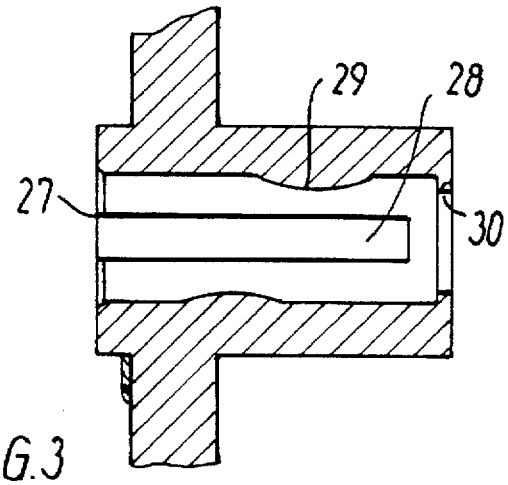
FIG. 3 is a cross-sectional view of a light exit opening on the element according to the invention along the line III—III in FIG. 1.

FIG. 1 shows the light exit openings 16, one of which is shown in cross-section in FIG. 3. It will seen that they are substantially cylindrical bushings which are formed with internally chamfered edges at the insertion end 27 for an optical fibre 31 (see FIG. 4), so that it serves as a hopper at the insertion of the fibre. The bushing has two slots 28 which extend along part of its total length. In the present case, the slot 28 extends up to the end wall of the part and continues there at a depth corresponding to the wall thickness of the bushing. Both slots 28 of the bushings are positioned in a plane containing the axis of rotation 13 of the rotatably mounted member.

The bushings have two opposed and slightly mutually offset, internal projections 29 which, by means of the flexibility of the bushings, form a clamping fit with a fibre 31 received in the bushing. Finally, an annular ring 30 is provided internally in the bushing 16, said ring serving as a bottom stop for an inserted fibre 31. Thus, the end face of the fibre will always be positioned in the same manner with respect to the housing of the building element.

It will be seen in FIG. 1 that the rotatably mounted member 14 has a shaft part 17, and this shaft park 17 has a through bore 19 in which a cruciform shaft or shaft part may be received and retained by friction. The shaft part 17 has two constrictions 37 at its ends, and these constrictions serve as bearing parts, as they cooperate with the holes 18 on the two parts 11 and 12, said holes 18 serving as bearing cups. The rotatable member 14 can hereby perform a well-defined rotation with respect to the housing, said member 14 being retained in its axial direction and being capable of rotating about two bearings spaced from each other.

The actual light source 15 is mounted on a separate disc 38 which may suitably be called a component mounting disc, as a voltage supply circuit is provided on one side of the disc opposite the light source 15, which may e.g. be a light emitting diode (LED), which voltage supply circuit provides the correct polarity for the voltage by means of a rectifier bridge, and a transistor based amplifier part provides a correct voltage level for the light source. The disc 38, which may be made of an ordinary printed circuit board, is provided with electrically conducting paths 39 on its other side for cooperation with a pair of collector shoes, which will be explained later.

The disc-shaped part of the shaft part 17 has three spacer pins 38 which ensure correct spacing from the light source 15 on the disc 38 with respect to the light exit openings 16 and thereby the fibres 31 arranged in these. Further, the shaft part 17 has a guide beam 34 which cooperates with a guide recess 36 on the disc 38, so that the parts forming the rotatable member cannot rotate with respect to each other. The light leaving the light source 15 will thus pass a recess 32 before it reaches the fibre ends. The shaft part 17 has two resilient arms 35 which retain the disc 38 against the spacer pins 33. The disc 38 may be released by pressing the arms 35 inwards, which is possible when there is no cruciform shaft in the shaft through bore.

Figure 2:
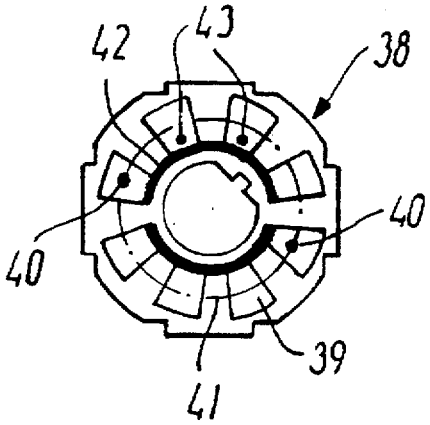
FIG. 2 shows the rear side of the component mounting ring shown in FIG. 1.

The disc 38 is shown in FIG. 2, and it will be seen that it has two thin, conducting paths 42 extending along a segment of the same circle coaxially with the axis of rotation 13, and that conducting faces 39—four for each of the paths 42—extend from the two conducting paths 42. Via bores 43, the two paths 39 filled with metallic conductor are connected to the other side of the disc, where they constitute the input terminals to the rectifier bridge.

It will be seen from FIG. 1 that the coupling studs 49 on the upper side of the part 11 provide electrical contact in addition to mechanical contact, said studs 49 having partially open sides 50 through which contact to the metallic conductors 48 may be established. This is described in the applicant's own Danish Patent No. 155 206. The contact knobs 48 are retained in the coupling studs 49 by geometrical locking and are connected in pairs via contact parts 47.

Each of these contact parts 47 has a downwardly extending flap on which conducting legs 45 are mounted via a guide part 46. The legs 45 have an inherent elasticity biasing the collector shoes 44 against the disc 38, so that the two collector shoes 44 will sweep over the faces 49 along a circle 41 with engagement at two points 40. The light source will hereby be supplied with voltage when a voltage supply terminal is arranged on the coupling studs 49, and the collector shoes 44 are in contact with the faces 39.

The fibre elements 31 may be omitted or be provided as other forms of light conductors, e.g. as beams.

Figure 4:
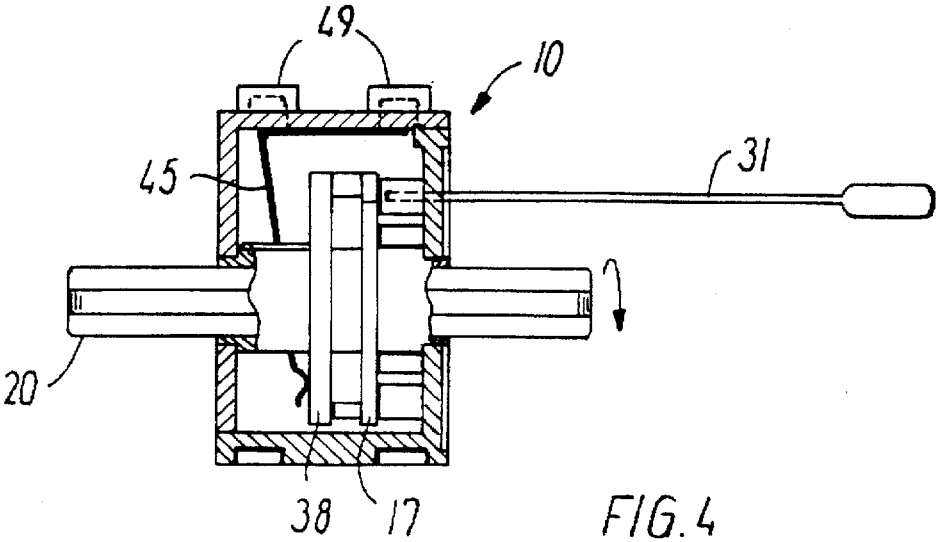
FIG. 4 is a cross-sectional view of the building element shown in FIG. 1.

FIG. 4 shows the building element 10 in cross-section, forming part of a constructional building set in connection with a plurality of optical fibre elements 31 for distributing light in the building set. Only one fibre element 31 is shown. The individual parts have the same reference numerals as in FIG. 1.

The light source 15 may be replaced by an external light source from which the light is supplied to the rotatable member 14 via light conductors.

I claim:

1. A building element (10) for a constructional building set and comprising a housing (11, 12) having a light emitter (15) mounted in it, said light emitter (15) being mounted in a rotatably mounted member (14) spaced from an axis of rotation (13) thereof, a switch means connected to said light emitter to interrupt electrical power to said light emitter, said housing (11, 12) including a wall having at least two light exit openings (16) through which the light from the light emitter (15) can leave the housing (11, 12) when the light emitter (15) has been aligned with said at least two light exit openings (16) by rotation of the rotatable member (14), and said rotatable member having means (19) for coupling with an external drive device (20), characterized in that said light emitter (15) is arranged to sweep across said wall during rotation thereof whereby in a first time interval to be aligned with one of said at least two light exit openings and during a second time interval to be facing said wall and to emit light only during said first time interval when it is aligned with one of said at least two light exit openings (16) and not to emit light in said second time interval.

2. A building element according to claim 1, characterized in that the housing (11, 12) has two opposed, substantially parallel walls which are formed with two aligned holes (18) serving as bearing rings for a through shaft part (17) which carries the rotatably mounted member (14).

3. A building element according to claim 2, characterized in that the rotatably mounted member (14) is in the form of a rotatable disc which is integral with the shaft part (17).

4. A building element according to claim 3, characterized in that the light emitter (15) is a light emitting diode mounted on a component side of a disc-shaped ring (38) of an insulating material, and that said switch means comprises metal paths (39) provided on another side formed of the ring (38) for cooperation with resilient collector shoes (44) connected to an electrical input terminal (50) in the housing (11, 12).

5. A building element according to claim 4, characterized in that the ring (38) is retained by means of geometrical locking on the shaft part (17) in parallel with and with respect to the rotatable disc, so that the light emitting diode emits light toward said at least one light exit opening (16) through a recess (32) in the rotatable disc.

6. A building element according to claim 1, characterized by a plurality of light exit openings (16) which are formed in one of the parallel walls of the housing (11, 12) along a circular arc corresponding to the distance travelled by the light emitter (15) by rotation of the rotatable member (14).

7. A building element according to claim 1, characterized in that the coupling means (19) of the rotatable member (14) comprise a cruciform through bore in the shaft part (17), in which an external drive device (20) in the form of a corresponding, cruciform drive shaft may be received releasably as a frictional fit.

8. A building element according to claim 4, characterized in that the metal paths (39, 42) on a disc-shaped ring are formed as plurality of circular segments (39) corresponding to the plurality of light exit openings (16), a first part of the circular segments (39) being electrically connected to a first node (43) on the component side of the ring, a second part of the circular segments (39) being electrically connected to a second node (43) on the component side of the ring.

9. A building element according to claim 1, characterized in that bushings are provided in the associated housing wall in connection with the light exit openings (16), and that the bushings are formed with an internal shoulder (30).

10. A constructional building set comprising a building element (10) having an incorporated light source (15) and a plurality of optical fibre elements (31) to distribute light in the building set, said building element (10) having a housing (11, 12) in which the light source (15) is incorporated, said light source (15) being mounted on a rotatably mounted member (14) spaced from the axis of rotation (13) thereof, a switch means connected to said light source to interrupt electrical power to said light source, said housing (11, 12) including a wall having at least two light exit openings (16) through which the light from the light source (15) can leave the housing (11, 12), when the light source has been aligned with one of said at least two light exit openings (16) by rotation of the rotatable member (14), and said rotatable member (14) having means (19) for coupling with an external drive device (20), characterized in that the rotatably mounted member (14) is enclosed by the housing (11, 12) and is freely rotatable about its axis of rotation (13) with respect to the housing (11, 12), and that the light exit openings (16) have a bushing part of a cross-section allowing the fibre elements (31) to be received and retained releasably through a frictional coupling with the bushing parts.

* * * * *